US005797284A

United States Patent [19]

Lurie

[11] Patent Number: 5,797,284

[45] Date of Patent: Aug. 25, 1998

[54] HIGH SECURITY HANDCUFFS

[76] Inventor: Alan E. Lurie, 52 Briarwood Dr., Huntington, N.Y. 11743

[21] Appl. No.: 686,172

[22] Filed: Jul. 22, 1996

[51] Int. Cl.[6] ..... E05B 75/00

[52] U.S. Cl. ..... 70/16

[58] Field of Search ..... 70/16, 14, 15, 70/17, 18, 19

[56] References Cited

U.S. PATENT DOCUMENTS

| | | | |
|---|---|---|---|
| 985,560 | 2/1911 | Widmayer | 70/16 |
| 1,775,727 | 9/1930 | Latou | 70/16 |
| 1,845,511 | 2/1932 | Neal | 70/16 |
| 1,900,242 | 3/1933 | Latou | 70/16 |
| 2,006,743 | 7/1935 | Nagle | 70/24 |
| 2,390,885 | 12/1945 | Kelley | 60/16 |
| 2,510,294 | 6/1950 | Rivolier | 70/16 |
| 3,392,554 | 7/1968 | Williamson | 70/16 |
| 3,616,665 | 11/1971 | Rosenthal | 70/16 |
| 3,618,345 | 11/1971 | Smith | 70/16 |
| 4,287,731 | 9/1981 | Kruger | 70/16 |
| 4,314,466 | 2/1982 | Harris | 70/16 |
| 4,509,346 | 4/1985 | Szczepanek | 70/16 |
| 4,574,600 | 3/1986 | Moffett | 70/16 |
| 4,694,666 | 9/1987 | Bellingham | 70/16 |
| 5,138,852 | 8/1992 | Corcoran | 70/16 |

FOREIGN PATENT DOCUMENTS

| | | | |
|---|---|---|---|
| 372619 | 5/1932 | United Kingdom | 70/16 |

*Primary Examiner*—Darnell M. Boucher
*Attorney, Agent, or Firm*—Darby & Darby

[57] ABSTRACT

A set of handcuffs having an improved locking mechanism. The locking mechanism preferably includes a cylinder lock that is positioned substantially parallel to the pivot axis of the locking arm. The keyway of the locking mechanism is spaced above the plane of the cheek plates of the body of the handcuffs and therefore is more difficult to access by the prisoner than prior art locking mechanisms. The locking mechanism may be set, by insertion of a key into the same keyway, in a ready to lock position in which the handcuffs can only be tightened but not loosened, or in a double locked position in which the handcuffs cannot be tightened or loosened. Preferably, the keyway of the locking mechanism is a restricted keyway such that only keys purchased directly from the manufacturer or someone licensed by the manufacturer or factory can be inserted into the keyway to adjust the setting of the locking mechanism.

5 Claims, 3 Drawing Sheets

HIGH SECURITY HANDCUFFS

BACKGROUND OF THE INVENTION

The present invention relates to handcuffs having an improved locking mechanism. More particularly, the present invention relates to handcuffs having a lock, preferably a cylinder lock, that is positioned and formed such that it is more difficult to pick by the prisoner or another individual, and which has a user friendly double locking mechanism.

Handcuffs are generally formed with a body having planar, substantially parallel cheek plates and a C-shaped extension to which a locking arm is pivotal connected. The locking arm typically has a free end with a series of ratchet teeth that engage the teeth of a pawl within the body. A locking mechanism is provided for locking the pawl, and thus the locking arm, with respect to the body of the handcuffs.

Often, handcuffs have more than one locking position. The first locking position may be referred to as a "ready to lock" position. In this position, the locking arm is permitted to continue to tighten around the prisoner's wrist or ankle without being loosened. This is because the pawl, in the "ready to lock" position, has limited upward movement and therefore can ride along the ratchet teeth to tighten the handcuffs (i.e., to pivot the locking arm closer to the body of the handcuffs) without moving upward sufficiently to rise over an end of a tooth to permit loosening of the handcuffs (i.e., pivoting of the locking arm away from the body of the handcuffs). The second locking position may be referred to as a "double locked" position. In this position, the locking arm cannot be moved in either direction (i.e., toward or away from the body of the handcuffs) because the pawl is securely engaged with the ratchet and cannot move upward at all.

Prior art handcuffs typically have a lock that uses a key that is little more than a piece of metal that acts to move a pawl within the lock. A paper clip, or other bendable yet sturdy element may be modified to perform the same function as the key. The lock of the prior art handcuffs also has a keyway that is relatively easy for the wearer of the handcuffs to access. The keys of such handcuffs are generally manufactured as "universal" keys that can be obtained from any handcuff supplier. Accordingly, a prisoner or an accomplice may easily obtain a copy of a key to release handcuffs placed around his wrists or ankles and thereby escape. Because the keyway is typically either on the side of the handcuff body (as in U.S. Pat. No. 3,392,554 to Williamson) or in the plane of the body's cheek plate (as in U.S. Pat. No. 5,138,852 to Corcoran), the prisoner generally does not have much difficulty inserting a key, on his own, into the keyway to unlock the handcuffs.

In order to prevent escapes facilitated by the use of a "universal" key, handcuffs have been designed with cylinder locks having multiple tumblers, such as shown in U.S. Pat. No. 3,392,554 to Williamson. The key that opens such a lock must be specially designed for that lock. Accordingly, a standard, "universal" key will not open such a lock, making procurement of a key to unlock the handcuffs more difficult. However, once the original key is obtained, duplicates may be created readily. Moreover, as described above, such locks typically are positioned and oriented in the handcuffs such that access to the keyway is not very difficult for the prisoner.

Another disadvantage encountered with prior art handcuffs is that the double locked position is typically achieved through the use of a separate double locking mechanism, which makes engagement of the double locking mechanism inconvenient for the police officer or user. This second mechanism typically is engaged via a separate slot or hole either on the side of the body, or on the cheek plate but on the reverse side of or at least spaced apart from the keyway for engaging the first locking position, such as shown in U.S. Pat. No. 4,574,600 to Moffett. In this patent, one end of the key is inserted into the keyway for engaging first locking position, and the other end of the key is inserted into the slot or hole for engaging the second locking position. Thus, it is relatively cumbersome to engage the double locking mechanism of this patent, not only because it has a separate access, but also because the orientation of the key must be reversed. Reversal of the key is very difficult to accomplish when placing the handcuffs on a prisoner that is resisting arrest/cuffing.

Moreover, double locking mechanisms such as shown in above-mentioned U.S. Pat. No. 4,574,600, and also in U.S. Pat. No. 1,845,511 to Neal, generally use a universal key. Thus, prior art handcuffs with such double locking mechanisms have the further disadvantage that a key can be easily obtained and copied.

Although the first and second locking positions of above-mentioned U.S. Pat. No. 3,392,554 are engaged in similar manners (i.e., by insertion of the same key into the same keyway), and thus are not cumbersome to engage, the double locking mechanism of this patent has the disadvantage of being too easy to activate. Specifically, the first and second locking positions are engaged by rotating the lock plug, without the need for inserting a key into the lock plug. Accordingly, it is not difficult for the lock to inadvertently slip into the double locked position.

SUMMARY OF THE INVENTION

A principal object of the present invention is to provide a set of handcuffs having a locking mechanism that is positioned and oriented in such a manner that access to the keyway by the prisoner is severely restricted.

A related object of the present invention is to provide a handcuff locking mechanism that is more difficult to pick than locking mechanisms using a "universal" key.

A further object of the present invention is to provide handcuffs having a double locking mechanism (which prevents both loosening and tightening of the handcuffs) that is accessible and activatable via the same keyway and with the same key used to access and activate the first locking mechanism (which places the handcuffs in a ready to lock position).

These and other objects of the invention are accomplished in accordance with the principles of the present invention by providing a set of handcuffs having a locking mechanism in each handcuff that is positioned and oriented to severely limit access to the keyway. Specifically, a cylinder lock is positioned within the body of the handcuffs substantially parallel to the pivot axis of the locking arm and with the plane of the keyway spaced from the plane of the cheek plates. The handcuffs are then placed on the prisoner with the keyway facing the upper arms of the prisoner and away from the prisoner's hands. Thus, when the handcuffs are on a prisoner, access to the keyway is severely impeded, especially because of the additional spacing of the keyway away from the plane of the cheek plates and thus away from the prisoner's hands. Additionally, the cylinder lock preferably has a limited access keyway, most preferably with multiple tumblers, to further restricted unauthorized opening of the handcuffs. In order to facilitate locking of the handcuffs, the cylinder lock is preferably further designed to permit positioning of the locking mechanism in either a ready to lock position or a double locked position through the insertion of the same key into the same keyway, without reversing the orientation of the key.

These and other features and advantages of the present invention will be readily apparent from the following detailed description of the invention taken in conjunction with the accompanying drawings, wherein like reference characters represent like elements.

DETAILED DESCRIPTION OF THE INVENTION

Figure 1:
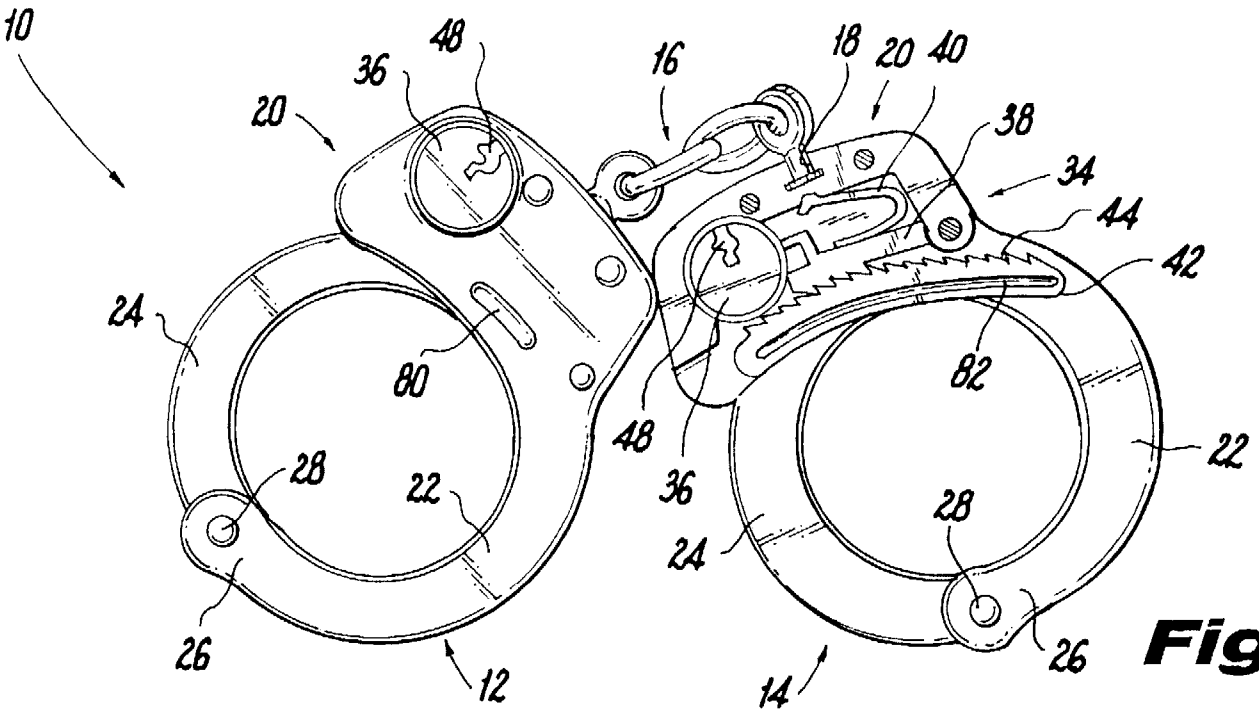
FIG. 1 is plan view of a set of handcuffs of the present invention.

A pair of handcuffs 10 formed in accordance with the principles of the present invention is shown in FIG. 1. Handcuffs 10 include substantially identical left and right individual handcuffs 12, 14 joined by chain 16 fastened in slot 18 in body portion 20 of each of handcuffs 12, 14. Because the individual handcuffs 12, 14 of the pair of handcuffs 10 are substantially identical, only one handcuff will be described in detail, the description of one handcuff being applicable to the description of the other handcuff. Each handcuff 12, 14 has a body portion 20 having a C-shaped portion 22 extending therefrom. A locking arm 24 is pivotally connected to the free end 26 of C-shaped portion 22, preferably via a pivot pin 28.

Figure 2:
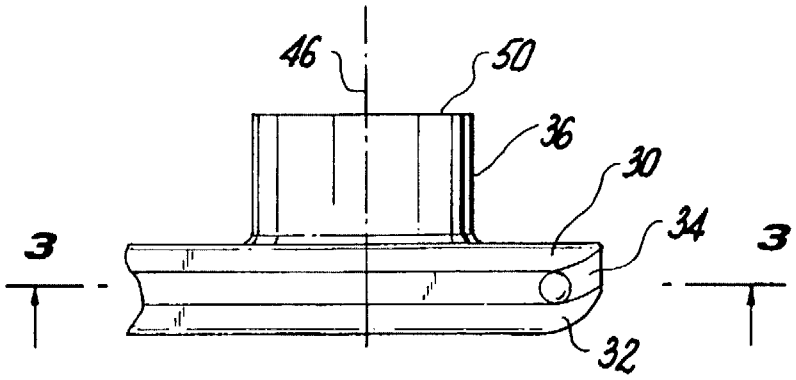
FIG. 2 is a partial side elevational view of the handcuffs of the present invention, showing a lock used in the present invention as connected to the body of the handcuffs in accordance with the principles of the present invention.

Body portion 20 is preferably formed from two substantially planar cheek plates 30, 32 that are spaced apart by locking mechanism housing 34 in substantially parallel planes, as may be seen in FIG. 2. Locking mechanism housing 34 houses lock 36, pawl 38, and pawl spring 40, whose functions will be described in further detail below. Free end 42 of locking arm 24 has a ratchet 44 that engages pawl 38 within locking mechanism housing 34 as well. Each of C-shaped portion 22 and locking arm 24 has a concave portion such that when free end 42 of locking arm 24 is positioned within locking mechanism housing 34, C-shaped portion 22 and locking arm 24 form a rounded interior that fits around the prisoner's wrist or ankle.

Lock 36 preferably is a cylinder lock that is positioned with its longitudinal axis 46 substantially perpendicular to the planes of the cheek plates 30, 32, and thus substantially parallel to the pivot axis of locking arm 24. Lock 36 has a keyhole or keyway 48 in keyway plane 50 which extend outwardly from cheek plate 30, such that keyway plane 50 is spaced from the plane of cheek plate 30, as may be seen in FIG. 2. Preferably, when handcuffs 10 are placed on a prisoner, cheek plate 30 faces the upper arms of the prisoner while cheek plate 32 faces the hands of the prisoner. Because of the orientation of lock 36 with respect to handcuffs 10 and the prisoner, when keyway 48 is positioned facing the prisoner (i.e., when cheek plate 30 faces the upper arms of the prisoner and cheek plate 32 faces the hands of the prisoner), access to keyway 48 by the prisoner is severely restricted. In particular, the additional spacing of keyway plane 50 from the plane of cheek plate 30 from which lock 36 extends restricts access to keyway 48 more so than in the prior art handcuffs in which the keyway is in the same plane as the cheek plate. The distance between keyway plane 50 and the surface of cheek plate 30 spaces the keyway 48 further away from the prisoner's hands and thus makes it more difficult for the prisoner to manipulate the key (should he come into possession of it) into the lock entryway or keyway 48 while his hands are secured in the handcuffs 12 and 14. Manipulating the key into the lock 36 is also made more difficult (for the prisoner secured in the handcuffs) because the keyway 48 faces away from the prisoner's hands and away from the plane of the cheek plate 30 from which lock 36 extends. In short, the orientation and protruding arrangements of the cylinder lock 36 impede the wearer from tampering with the cuffs by impairing his access to the keyway 48.

Another feature of lock 36 of the present invention is that lock 36 preferably has a restricted keyway, such as a keyway manufactured by Medeco Security Locks, specifically for the manufacturer or owner of the handcuffs of the present invention. A restricted keyway prevents unauthorized access to additional keys or key blanks because all keys and key blanks of restricted keyways are available only from a restricted source. Thus, keys and key blanks must be purchased directly from the manufacturer/factory, or from someone licensed by the manufacturer/factory. Accordingly, the key to lock 36 of handcuffs 10 is not commercially available, and blank keys would not be available to anyone without comparing the required on-file signatures. In contrast, existing restraint keys are commercially available, and generally are manufactured as a "universal" key that can be obtained from just about any mail order "Soldier of Fortune" type magazine. Thus, in accordance with the principles of the present invention, handcuffs 10 are more difficult to pick than prior art handcuffs. In addition to using a restricted keyway, it is also preferable to use a pick resistant pin tumbler cylinder, preferably having a plurality of pin tumblers of different lengths. Accordingly, multiple tumbler, pick resistant lock 36 is more difficult to pick than prior art locks for this reason as well.

Figure 3:
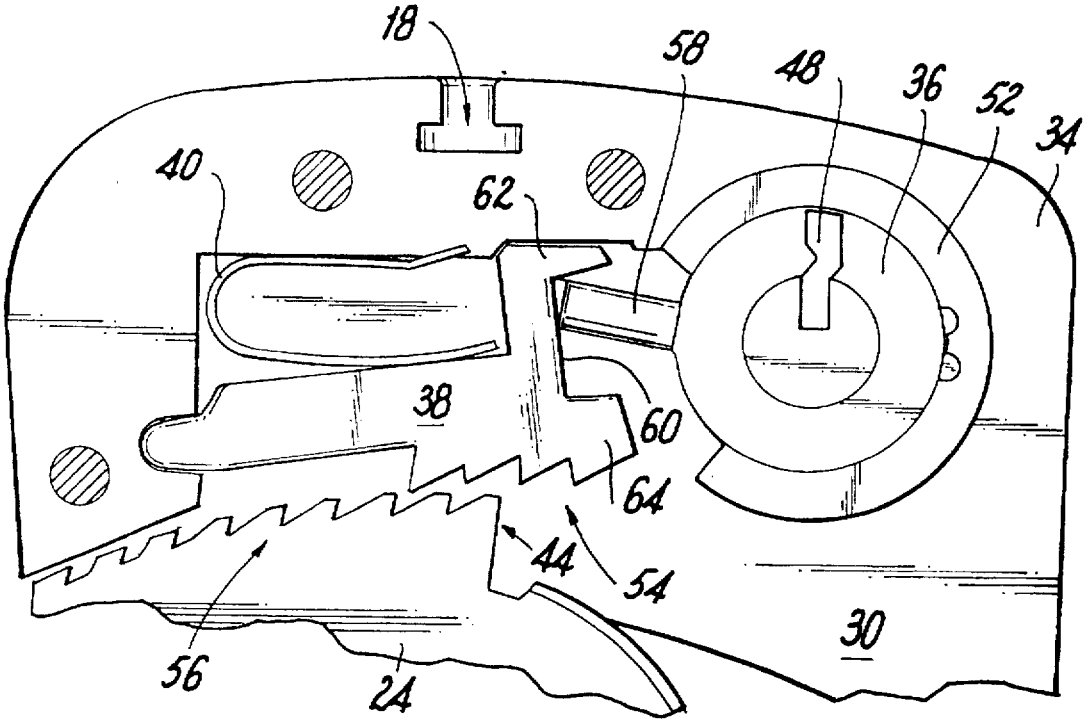
FIG. 3 is a partial sectional view, along line 3—3 of FIG. 2, of the locking mechanism of the present invention in the unlocked, completely disengaged position.
Figure 4:
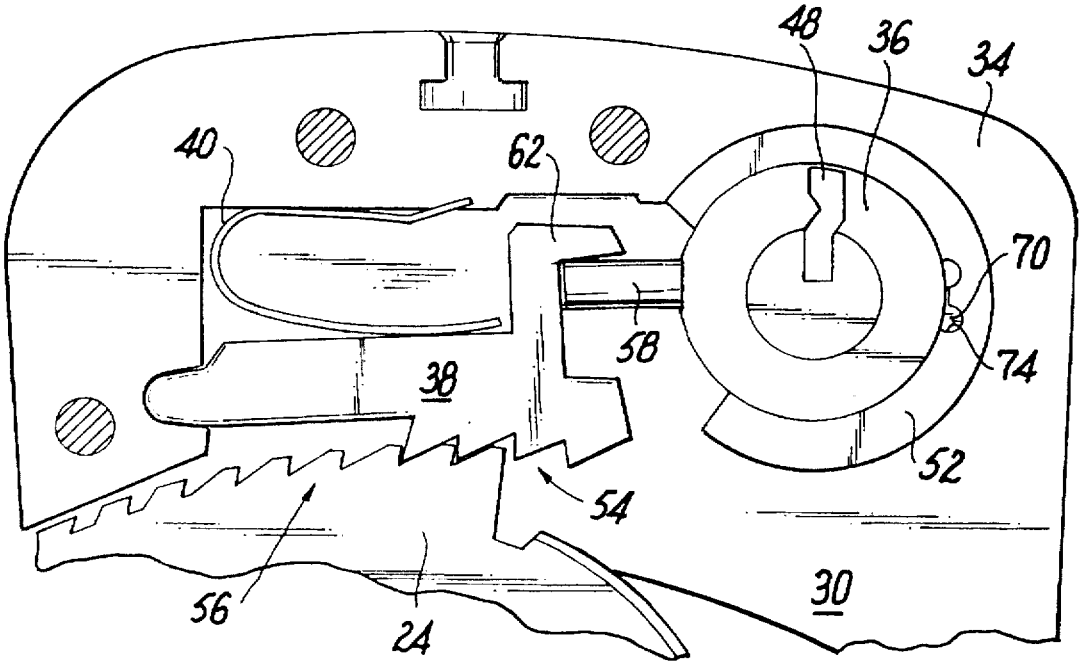
FIG. 4 is a partial sectional view, along 3—3 of FIG. 2, of the locking mechanism of the present invention in the ready to lock position.
Figure 5:
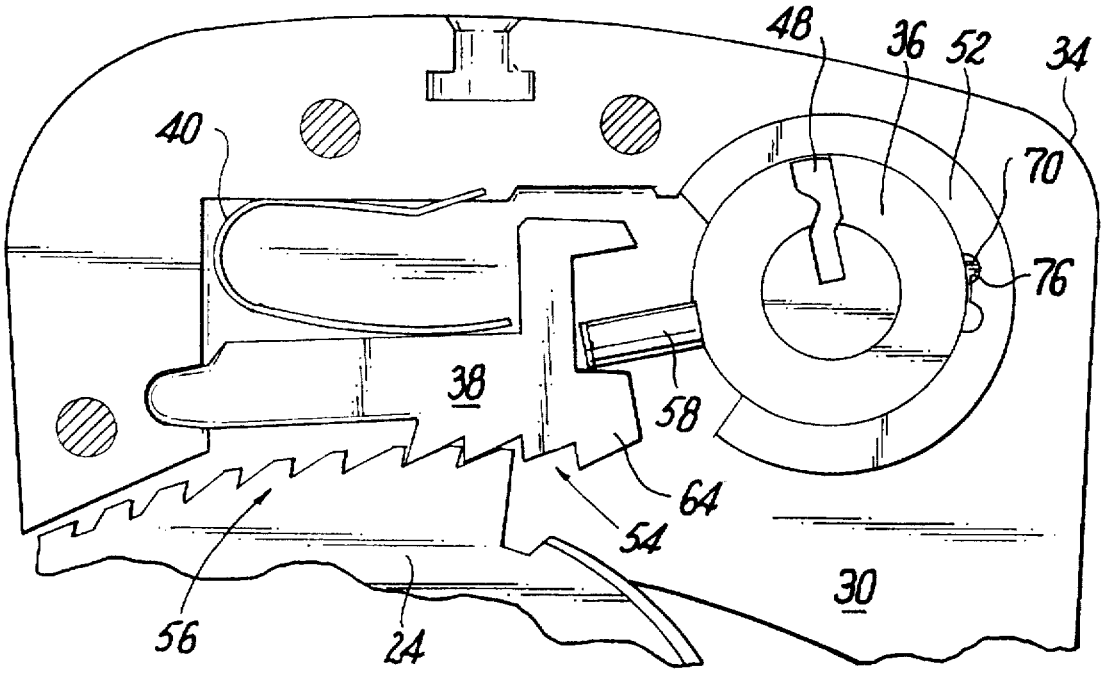
FIG. 5 is a partial sectional view, along 3—3 of FIG. 2, of the locking mechanism of the present invention in the double locked position.

As in prior art handcuffs, the locking mechanism of handcuffs 10 has three locking positions, as shown in FIGS. 3–5. It is noted that the locking mechanism shown in FIGS. 3–5 is that of left handcuff 12 and therefore is in the reverse orientation from that of the right handcuff 14 locking mechanism shown in FIG. 1. Thus, while clockwise rotation of locking arm 24, as viewed in FIG. 1, causes tightening of right handcuff 14, counterclockwise rotation of locking arm 24, as viewed in FIGS. 3–5, causes tightening of left handcuff 12.

The locking mechanism of handcuffs 10, positioned within locking mechanism housing 34, includes lock 36 within cylinder lock shell 52, pawl 38, pawl spring 40, and ratchet 44 (on free end 42 of locking arm 24), as described above. Pawl spring 40 biases pawl teeth 54 of pawl 38 into engagement with ratchet teeth 56 of ratchet 44. Lock 36 has a radially extending retaining pin 58 received within receiving slot 60 of pawl 38. Slot 60 is defined by an upper arm 62 and a lower arm 64. The relation of retaining pin 58 with respect to arms 62 and 64 affects the locking position of pawl 38 because retaining pin 58 can bias pawl 38 against pawl spring 40 and thereby vary the amount by which pawl teeth 54 can be moved out of engagement (if at all) with ratchet teeth 56, as described below.

The locking mechanism of handcuffs 10 is in the "completely disengaged," or unlocked, position when in the configuration shown in FIG. 3. In this position, retaining pin 58 is at its highest position and engages upper arm 62 of pawl 38. Accordingly, pawl teeth 54 are completely disengaged from ratchet teeth 56 such that locking arm 24 can freely move with respect to locking mechanism housing 34. In other words, locking arm 24 is free to pivot about pivot pin 28 either counterclockwise or clockwise to either tighten or loosen, respectively, the handcuffs.

In the second of the three locking positions, the locking mechanism of handcuffs 10 is in the "ready to lock" position shown in FIG. 4. In this position, keyway 48 is in the 12:00 position and retaining pin 58 is substantially horizontal. Horizontally oriented retaining pin 58 engages upper arm 62 of pawl 38 to partially bias pawl spring 40 and thereby permit pawl 38 restricted movement in the upward direction only. Thus, when locking arm 24 begins to swing closed (i.e., pivots in a counterclockwise direction as viewed in FIG. 4) pawl 38 can move up and down as locking arm 24 is closed and ratchet teeth 56 ride along pawl teeth 54. However, locking arm 24 is prevented from rotating backward (i.e., clockwise) to loosen handcuff 12 by the interlocking angles on ratchet teeth 56 and pawl teeth 54. Thus, only tightening of the handcuff is permitted, i.e., locking arm 24 is only permitted to move closer to C-shaped portion 22 and cannot pivot away from C-shaped portion 22.

The "double locked" position of the locking mechanism of handcuffs 10 is shown in FIG. 5. In the double locked position, lock 36 is rotated such that retaining pin 58 is rotated down against lower pawl arm 64, preventing pawl 38 from moving in an upward direction. Thus, pawl teeth 54 are locked against ratchet teeth 56 and cannot move upwards to permit further locking of locking arm 24 with respect to body 20. In this position, neither tightening nor loosening of the handcuff is permitted, i.e., locking arm 24 is not permitted to pivot either closer to C-shaped portion 22 (to tighten the handcuff) or away from C-shaped portion 22 (to loosen the handcuff). This prevents inadvertent injuries to the prisoner due to crushing of the wrist or ankle.

As may be understood from the above descriptions, the locking mechanism of the present invention is put into the double locked position by inserting the same key into the same keyway used for putting the locking mechanism in the "ready to lock" position. Thus, the person securing the handcuffs on the prisoner need not remove the key from the keyway 48 when moving the locking mechanism between the three available locking positions.

Figure 6:
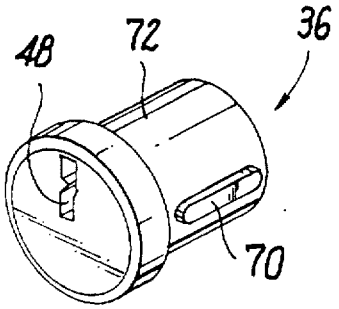
FIG. 6 is a perspective view of a cylinder lock of the present invention, isolated from the handcuffs of the present invention.
Figure 7:
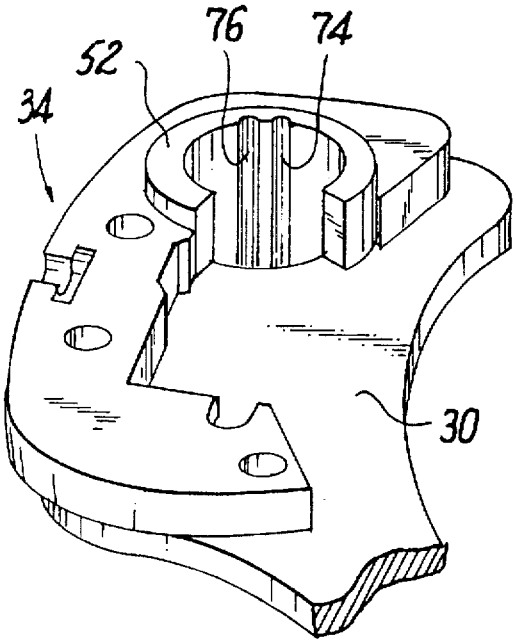
FIG. 7 is a partial perspective view of one of the cheek plates of the present invention without the locking mechanism in place and showing the cylinder lock shell.

In order to maintain the locking mechanism in the desired locking position, a side bar 70 is provided in lock cylinder 72 of lock 36, as shown in FIG. 6. Side bar 70 is shaped to fit within one of slots 74, 76 formed in cylinder lock shell 52 in locking mechanism housing 34 shown in FIG. 7. When a key is inserted into keyway 48, side bar 70 is free to move inward into lock cylinder 72, allowing lock cylinder 72 to rotate freely within cylinder lock shell 52. When the key is removed, side bar 70 protrudes from lock cylinder 72 and cannot be depressed inward. Side bar 70 preferably is spring loaded and biased outwardly from the lock cylinder 72. Alternatively, side bar 70 can be formed such that it is locked with respect to lock cylinder 72 yet cannot move inwardly when a key is not in keyway 48, and thus is locked in a protruding position only if already in that position when the key is removed.

Side bar 70 is useful in maintaining cylinder lock 36 in a desired orientation because side bar 70 may be locked in one of slots 74, 76 when a key is not positioned within keyway 48, as follows. When cylinder lock 36 and keyway 48 are in the"ready to lock" (12:00) position, as shown in FIG. 4, side bar 70 fits into lower slot 74 in cylinder lock shell 52. Without inserting a key into keyway 48, side bar 70 will not be allowed to be depressed within cylinder lock 36, thereby preventing cylinder lock 36 from rotating. This maintains the locking mechanism in the "ready to lock" position.

When cylinder lock 36 and keyway 48 are in the double locked position shown in FIG. 5, side bar 70 fits into upper slot 76 in cylinder lock shell 52. Again, without inserting the key into keyway 48, cylinder lock 36 cannot rotate because side bar 70 cannot be depressed within cylinder lock 36. This maintains the locking mechanism in the double locked position.

In order for the locking mechanism of handcuffs 10 to be completely disengaged to allow removal from the prisoner, a key must be inserted to allow side bar 70 to withdraw into cylinder lock 36 while rotating cylinder lock 36. The key must then be rotated approximately 10° in a direction away from slots 74, 76 to move retaining pin 58 and pawl 38 upward. This allows side bar 70 to be depressed, without falling into either of side bar slots 74, 76 during rotation, thereby allowing cylinder lock 36 to rotate and lift pawl 38 to cause locking arm 24 to become free to swing open. Preferably, cylinder lock 36 has a captive key operation. This means that the key cannot be removed from keyway 48 in the "completely disengaged" position. This serves as an extra degree of safety for the police officer or other user.

Another feature that may be provided in handcuffs 10 is a stamped in area 80 in at least one, and preferably both, of cheek plates 30, 32. Stamped in area 80 engages groove 82 in locking arm 24, extending along ratchet teeth 56. This engagement aids in preventing a prisoner from attempting to separate the locking arm 24 from interlocking pawl 38 within locking mechanism housing 34 by pulling downward on locking arm 24. It will be understood that the dimensions of stamped in area 80 and groove 82 may be modified from the shapes and dimensions shown in the figures. For example, the stamped in area 80 and groove 82 may be made longer and wider than those shown in the figures.

While the foregoing description and drawings represent the preferred embodiments of the present invention, it will be understood that various additions, modifications and substitutions may be made without departing from the spirit and scope of the present invention as defined in the accompanying claims. In particular, it will be clear that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A handcuff having first and second locking positions set by inserting a single key into a single keyway and rotating said single key in said single keyway, said handcuff comprising:

a body having a set of substantially planar cheek plates lying in substantially parallel planes;

a locking arm having a pivot end pivotally connected to said body, a free end selectively positionable in said body, and a concave engaging surface;

a locking mechanism having said single keyway, said locking mechanism comprising a pawl positioned within said body and having pawl teeth, and a ratchet on said free end of said locking arm and having ratchet teeth engaging said pawl teeth;

in said first locking position, said pawl has limited movement with respect to said ratchet such that said pawl can ride along said ratchet to permit said locking arm to move in a tightening direction to thereby tighten said handcuff;

in said second locking position, said pawl is locked with respect to said ratchet such that said pawl teeth and said ratchet teeth interengage and cannot be moved apart;

said locking mechanism further comprising a cylinder lock positioned within a cylinder lock shell and rotatable within said cylinder lock shell between said first locking position and said second locking position;

said cylinder lock having a radially extending retaining pin and a side bar selectively extendable from said cylinder lock;

said cylinder lock shell has first and second slots into which said side bar selectively extends;

in said first locking position, said side bar is positioned within said first slot in said cylinder lock shell so that said retaining pin locks said pawl with respect to said ratchet to place said locking mechanism in said first locking position;

in said second locking position, said side bar is positioned within said second slot in said cylinder lock shell so that said retaining pin locks said pawl with respect to said ratchet to place said locking mechanism in said second locking position;

said pawl having a receiving slot into which said retaining pin extends;

rotation of said cylinder moves said retaining pin in said receiving slot to thereby move said pawl with respect to said ratchet and into one of said first and second locking positions; and wherein:

said locking arm is pivotable with respect to said body in either a tightening direction which brings said concave engaging surface of said locking arm closer to said body, or a loosening direction which brings said concave engaging surface of said locking arm away from said body; and said locking mechanism is selectively positionable, by positioning and rotating said single key in said keyway, between a first locking position in which said locking arm is free to pivot in only said tightening direction and is locked against pivoting in said loosening direction, and a second locking position in which said locking arm is double locked against pivoting in both said tightening direction and said loosening direction.

2. A handcuff as in claim 1, wherein extension of said side bar from said cylinder lock is controlled by insertion of said key into said keyway.

3. A handcuff as in claim 1, wherein said cylinder lock is a multiple tumbler cylinder lock.

4. A handcuff as in claim 1, wherein said cylinder lock has a restricted keyway such that said key fitting within said keyway must be formed on a different basic blank than keys for existing handcuffs.

5. A handcuff as in claim 1, wherein:

said body comprises a C-shaped extension having a free end;

said locking arm is pivotally connected to said free end of said C-shaped extension; and said concave surface of said locking arm faces the concave surface of said C-shaped extension, said concave surfaces being brought closer together upon pivoting said locking arm in said tightening direction, and further apart upon pivoting said locking arm in said loosening direction.

* * * * *